United States Patent [19]

Watermann et al.

[11] Patent Number: 4,946,316

[45] Date of Patent: Aug. 7, 1990

[54] METHOD AND DEVICE FOR MOVING A SHIELD-TYPE SUPPORT TRESTLE

[75] Inventors: Willy Watermann, Dortmund; Herman-Josef Schulze-Heiming, Datteln/Horneburg, both of Fed. Rep. of Germany

[73] Assignee: Klöckner-Becorit GmbH, Fed. Rep. of Germany

[21] Appl. No.: 381,839

[22] Filed: Jul. 19, 1989

[30] Foreign Application Priority Data

Jul. 26, 1988 [DE] Fed. Rep. of Germany ..... 3825276

[51] Int. Cl.[5] ..... E21D 23/16

[52] U.S. Cl. ..... 405/302; 405/297; 405/298; 91/170 MP; 299/33

[58] Field of Search ..... 405/297, 298, 302; 91/170 MP, 517; 299/31-33

[56] References Cited

U.S. PATENT DOCUMENTS

| | | | |
|---|---|---|---|
| 3,207,041 | 9/1965 | Phillips | 405/302 X |
| 3,821,880 | 7/1974 | Weirich et al. | 405/302 |
| 4,379,662 | 4/1983 | Block | 405/302 |
| 4,440,522 | 4/1984 | Dettmers et al. | 405/302 X |
| 4,465,408 | 8/1984 | Krieger et al. | 405/302 |

*Primary Examiner*—Randolph A. Reese
*Assistant Examiner*—John A. Ricci
*Attorney, Agent, or Firm*—Watson, Cole, Grindle & Watson

[57] ABSTRACT

A method and device is provided for the moving of a shield-type support trestle 1 having stamps 4, 5 arranged between a roof pressure cap 3 and a lying skid 2, a pushing ram 6 is in the lying skid 2, and control valves 11, 12, 13, 14 for controlling the desired functions of the shield-type support trestle 1. The stamps 4, 5 have an inlet valve 22 and a discharge valve 4. A pressure line 40 is provided between control valve 13 and the pushing ram 6. A valve 51 is provided which is controlled by the pressure in the pressure line 40 and by which interconnects stamp pressure chambers. A manometric switch 48 is arranged on the pressure line 40 and activates an electronic control device 42. In lines 53, 55, and 29 between the stamp pressure chambers and the return line 18, an unlockable reflux valve 54 is provided which is actuated through the electronic control device 42 and the discharge valve 24. This device allows the trestle to be moved with a constant support pressure in spite of varying surface conditions in a mine.

21 Claims, 2 Drawing Sheets

METHOD AND DEVICE FOR MOVING A SHIELD-TYPE SUPPORT TRESTLE

BACKGROUND OF THE INVENTION

1. Technical Field of the Invention

The present invention relates generally to mine tunnel supports and more specifically to a method and device for moving a shield-type support trestle.

2. Discussion of the Related Art

Shield-type support trestles are often employed to support roofs of mine tunnels. The trestles have stamps arranged between a roof pressure cap and a lying skid for providing support to the roof. A pushing ram is provided in the lying skid to allow the trestle to move within the tunnel.

It is known to move such a trestle under load or partial load. The set shield-type support trestle is first partially depressurized and then moved under partial load. After this move is completed, the shield-type support trestle is positioned again with full load. This known movement under a partial load is accomplished with a constant distance between roof pressure cap and lying skid. Accordingly, this moving process is only possible when the roof and the bottom run fairly parallel to each other, so that the shield-type support trestle retains firm contact with the tunnel roof and the roof is not damaged because of excessive resistance during moving. Therefore, this current method is not adaptable to varying surface conditions encountered by the lying skid.

Accordingly, it is an object of the present invention to provide a method and device for moving a shield-type support trestle which both provides sufficient support force to the roof during the moving process and sufficiently protects the roof independently of existing topographical conditions of the tunnel.

Additional objects and advantages of the present invention will become apparent from the drawings and description which follow.

SUMMARY OF THE INVENTION

The foregoing and additional objects are obtained by a method according to the present invention. First, the pressure in chambers of the stamps is reduced to a desired remainder pressure. The pushing ram is pressurized within a certain given time span ranging from before attaining the remainder pressure until after this attainment. After this attainment, the trestle is advanced by the pressurized pushing ram. Throughout the whole moving process, the remainder pressure in the stamps is held constant. Upon completion of the move, the shield-type support trestle is positioned under full load by increasing the pressure in the stamp chambers.

This provides for a method of moving a shield-type support trestle at constant pressure, whereby the desired partial load pressure is held constant even if the seam thickness changes. Simultaneously, the roof is protected because the support force of the shield-type support trestle does not exceed the desired height during the advance. In addition, the development of dust below ground is counteracted because less rock is crushed between the tunnel roof and the roof pressure cap since the desired pressure is held constant throughout the move.

The present invention is designed such that the stamp pressure chambers of the stamps are connected to each other. An electronic control device is activated by pressure existing in a pressure line of the pushing ram, which in turn acts on the discharge valve. The discharge valve actuates an unlockable reflux valve arranged between the stamp pressure chambers and the return line. For this reason, only one pressure transducer is needed for measuring the stamp pressure. By the activation of the electronic control device, the latter can operate both the discharge valve and the inlet valve of the stamps.

Suitably, the pressure of the stamp pressure chambers is transmitted to the electronic control device from a value slightly above the desired remainder pressure, by which the unlockable reflux valve is held open via the discharge valve until the desired remainder pressure is attained.

In case of back pressure in the return line, the medium flowing out of the stamp pressure chambers is released to the outside. In this manner it is assured that a pressure reduction is always possible, even in case of back pressure in the return line. If the pressure is below the desired remainder pressure, the inlet valve may be activated by the electronic control device and the pressure in the stamp pressure chambers accordingly increased.

Another method is also provided for effectively moving by the trestle. First, the shield-type support trestle is positioned. Next, the pushing ram is acted on with pump pressure. Upon certain pressure in the pushing ram, an electronic control device is activated through a manometric switch. During a certain time span through a time function, the electronic control device activates an unlockable reflux valve located in the line between the stamps and the return line.

Next, the stamp pressure is lowered through the electronic control device until the shield-type support trestle advances at a certain given moving pressure in the pushing ram. Throughout this advance, the moving pressure is held constant. After the completed advance, the shield-type support trestle is positioned by altering pressure in the stamp chambers. This second method provides for the advantages described above in reference to the first method.

The invention also concerns a device to accomplish this moving of the shield-type support trestle. According to one embodiment of this device, a pressure line is provided between the pushing ram and a control valve communicating with a piston chamber of the pushing ram. A valve is provided which is controlled by the pressure existing in the pressure line and which interconnects the stamp pressure chambers. A manometric switch is arranged on the pressure line, by which an electronic control device can be activated. In addition, an unlockable reflux valve is provided in the line between the stamp pressure chambers and the return line. The unlockable reflux valve is actuated by the electronic control device and a stamp discharge valve.

This device assures that the shield-type support trestle provides an even and constant support force during the whole moving process, even when unfavorable geological conditions are encountered. In addition, the tunnel roof is protected during the moving process.

The moving device can have a pressure transducer provided between the stamp pressure chambers of the stamps and the electronic control device. This transducer triggers the electronic control device at a certain set pressure. Also, another discharge valve may be provided which is actuated by the pressure existing in the return line. This discharge valve assures that the stamp pressure can be lowered if back pressure develops in the return line.

A second embodiment of the device includes an electronic control device connected, via a manometric switch and a pressure transducer, to the pressure line located between the control valve and the pushing ram. A discharge valve and an inlet valve can be operated via the electronic control device. An unlockable reflux valve is actuated by the discharge valve and the inlet valve and is located in a line between the stamps and the return line. In addition, the pressure chambers of the stamps are interconnected through a valve actuated by the pressure line of the pushing ram. This second embodiment has the same advantages as the above-discussed first device.

As in the first embodiment, another discharge valve may be actuated by the return line so that the pressure control is independent of possible back pressure in the return line. In addition, the discharge valve may be activated for a time period of about 1 to 2 seconds by the electronic control device.

DETAILED DESCRIPTION OF THE PREFERRED EMBODIMENTS

Figure 1:
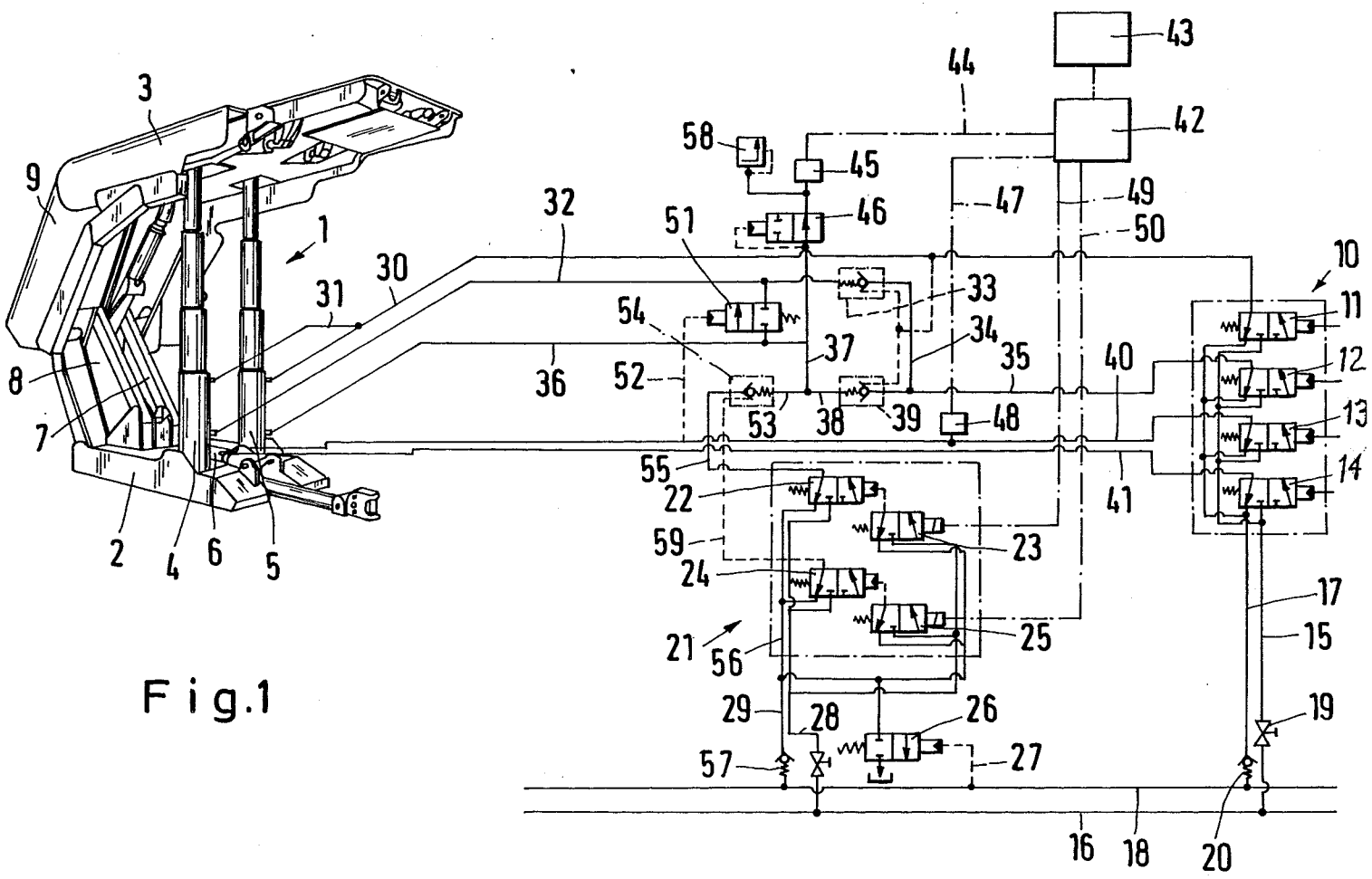
FIG. 1 depicts a first embodiment of the present invention.

Referring to FIG. 1, a device is shown for moving a shield-type support trestle 1 having stamps 4 and 5 located between the lying skid 2 and a roof pressure cap 3 as well as a pushing ram 6 in the lying skid 2. Two links 7 and 8 are provided between lying skid 2 and roof pressure cap 3. A digging shield 9 is flexibly mounted on these links.

A control unit 10 is provided and consists of control valves 11, 12, 13 and 14. The control unit 10 is connected through line 15 to a pressure line 16 and through line 17 to a return line 18. A locking device 19 is provided in line 15 and a reflux valve 20 is provided in line 17.

A control valve 21 for stamp pressure adjustment is also provided, consisting of an inlet valve 22 with a relay valve 23 and a discharge valve 24 with a relay valve 25. The inlet valve 22 and the discharge valve 24, as well as the relay valves 23 and 25, are connected through line 28 to the pressure line 16 and through line 29 to the return line 18.

In addition, another discharge valve 26 is provided which can be acted on through a control line 27 in response to the pressure of the return line 18.

The control valve 11 is connected through lines 30 and 31 to the annular chambers of stamps 4 and 5.

The stamp pressure chamber of stamp 4 is connected through line 32, a reflux valve 33 and line 34 to a line 35 which leads to the control valve 12. The stamp pressure chamber of stamp 5 is connected through lines 36, 37 and 38 as well as a reflux valve 39 to line 35 leading to control valve 12.

The control valve 13 is connected through line 40 to the piston chamber of the pushing ram 6, while the control valve 14 is connected through line 41 to the annular chamber of the pushing ram 6.

In addition, an electronic control device 42 is provided which is connected to a supply unit 43. The electronic control device 42 is also connected via an electrical line 44 through a pressure transducer 45 and a manometric protection valve 46 to lines 36, 37 and 38. A pressure control valve 58 is provided between the manometric protection valve 46 and the pressure transducer 45.

In addition, the electronic control device 42 is connected through an electrical line 47 and a manometric switch 48 to line 40. The control device 42 is also connected via an electrical line 49 to the relay valve 23 and via an electrical line 50 to the relay valve 25.

The two stamp pressure lines 32 and 36 are connected to each other by a valve 51. A control line 52 leads from the valve 51. A line 53 leads from lines 37 and 38 to an unlockable reflux valve 54, from which a line 55 leads through the inlet valve 22. A line 56 leads from inlet valve 22, through a reflux valve 57, to the return line 18.

It should be noted that all valves shown in FIG. 1 are in their resting position.

When the control valve 13 is operated, line 40 is connected to the pressure supply line 15. Thus, the piston chamber of the pushing ram 6 is pressurized. Through the same impulse, valve 51 is switched through control line 52 so that the two lines 32 and 36 are interconnected. Thus, the two piston chambers of stamps 4 and 5 are also interconnected. In this manner, the stamp pressure is also applied to the manometric protective valve 46.

The electric control device 42 is activated through the manometric switch 48 via the impulse in line 40. The electric control device 42 actuates discharge valve 24 through line 50 by means of the relay valve 25 so that the pressure of pressure line 6 is passed through line 28, discharge valve 24 and control line 59 to the opened unlockable reflux valve 54. This causes the pressure medium to flow from the stamp pressure chambers of stamps 4 and 5 through the lines 32 and 36 as well as through lines 37 and 53, through the opened reflux valve 54, and through line 55, inlet valve 22 and line 56 into the return line 18.

When the pressure in the stamp pressure chambers has been lowered to a predetermined value, the manometric protective valve 46 opens so that this pressure is measured by the pressure transducer 45 and passed through line 44 to the electronic control device 42. Preferably, the stamp pressure chambers are depressurized to 30 bar. From this predetermined pressure of 30 bar, the stamp pressure is further lowered through the electronic control device 42 to a previously set remainder pressure of, for example, 10 bar. As soon as the remainder stamp pressure of 10 bar is reached, the advancing motion of the the shield-type support trestle 1 starts.

If during the advance of the trestle 1 the stamp pressure falls below a lower limit pressure of, e.g., 8 bar, the stamps 4 and 5 are pressurized by the inlet valve 22 and the unlockable reflux valve 54 until the set desired remainder pressure of, e.g., 10 bar is once again reached.

On the other hand, the stamp pressure may rise above an upper limit pressure of, e.g., 12 bar during the advance. Such a rise may be caused by forward movement into a wedge. In this case, stamps 4 and 5 are adjusted back to the desired remainder value by the discharge valve 24 through triggering of the unlockable reflux valve 54.

If the stamp pressure cannot be lowered to the previously set reminder value of, e.g., 10 bar, the cause might be a back pressure in the return line 18 which is above the set remainder value of about 10 bar. In this instance, the separate discharge valve 26 is actuated by the pressure in the return line 18 through the control line 27. In this manner, pressure medium is released via the back pressure into the open air.

When the advance distance is terminated, the control valve 13 is returned to its unactuated position. As soon as the pressure in the piston chamber of the pushing ram 6, and thus also in line 40, has dropped below a predetermined level of, e.g., about 50 bar, the manometric switch switches the electronic control device 42 off.

Due to this pressure drop, valve 51 also returns to its locked position so that the two stamps 4 and 5 are again separated from each other.

Finally, stamps 4 and 5 are activated by altering the pump pressure via the operation of control valve 12 and accordingly the trestle is positioned as desired.

Figure 2:
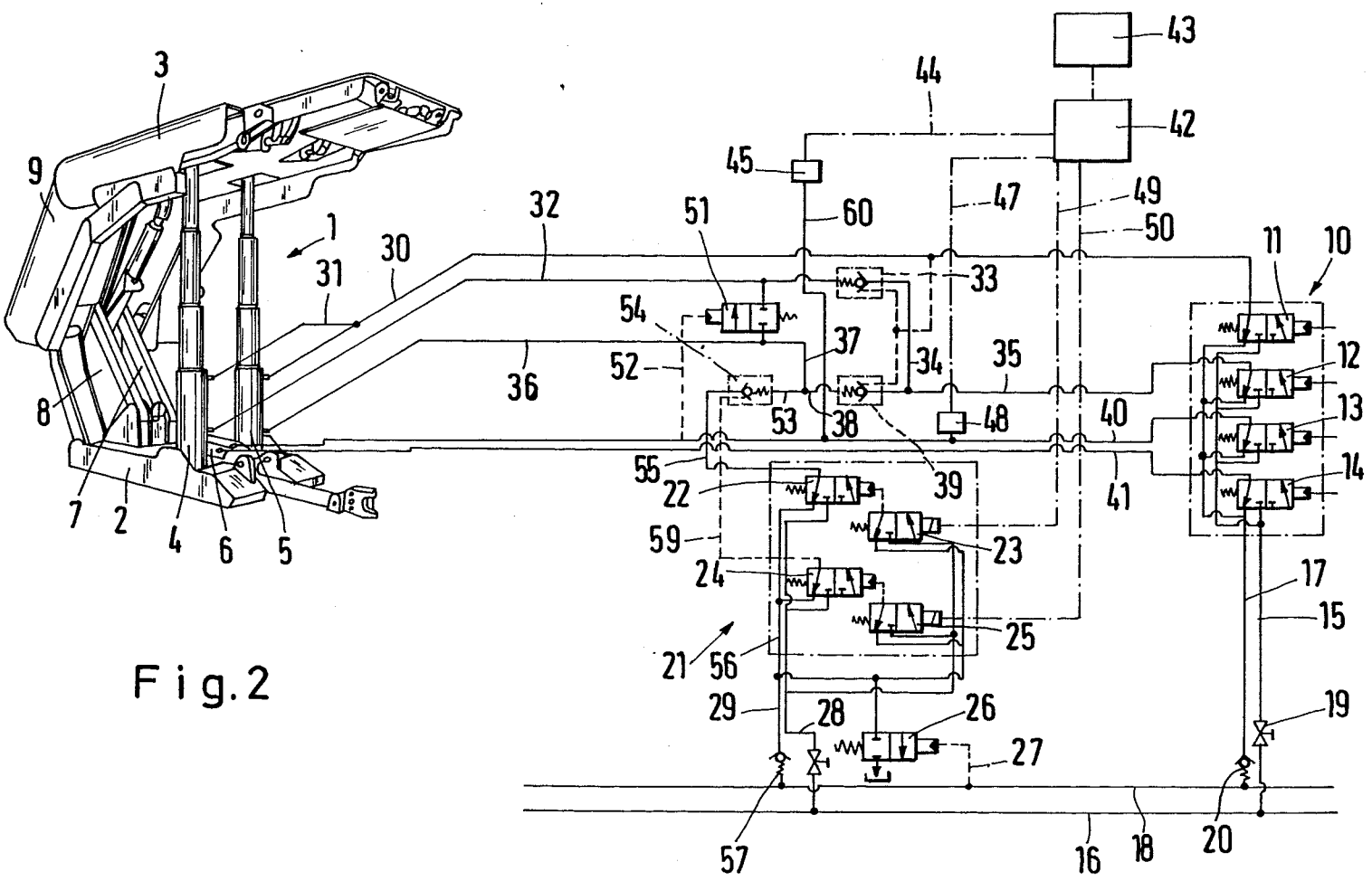
FIG. 2 depicts a second embodiment of the present invention.

Referring now to FIG. 2, a second embodiment is shown which differs from the above described first embodiment according to FIG. 1 by the fact that the pressure transducer 45 is connected through a line 60 to line 40 and that the manometric protective valve 46 and the pressure release valve 58 of the first embodiment are not provided. Otherwise, the same components are present as described above in reference to FIG. 1.

By activating the control valve 13, the pushing ram 6 is pressurized. Simultaneously, valve 51 is switched by the impulse in line 40 so that the two stamp pressure chambers of stamps 4 and 5 are connected to each other through lines 32 and 36 as well as through valve 51.

As soon as a certain pressure of, e.g., about 50 bar is reached in the pushing ram 6 and thus also in line 40, the electronic control device 42 is activated through the manometric switch 48. The control device 42 operates the discharge valve 24 with a time function for about 1 to 2 seconds. After this time, the pressure transducer 45 measures the pressure in line 40 and transmits this information to control device 42. Relay valve 25 is actuated via line 50 and in turn operates the discharge valve 24. This actuates the unlockable reflux valve 54 so that the pressure chambers of stamps 4 and 5 are depressurized, thereby lowering the stamp pressure. In the pushing ram, a moving pressure of about 200 bar is maintained. As soon as the pressure in the stamps 4 and 5 has fallen to a sufficiently low value, the shield-type support trestle 1 advances. During the advance of the shield-type support trestle 1, the moving pressure in the pushing ram 6 is monitored through the pressure transducer 45. The corresponding information is passed on to the electronic control device 42, which maintains the moving pressure at a constant value as discussed below.

If the pressure in the pushing ram 6 drops below the previously set value of about 200 bar during the advance motion, the action on the discharge valve 24 is terminated whereby the discharge valve 24 and the relay valve 25 fall back to their basic position. If the pressure transducer 45 reports pressure below a certain point to the electronic control device 42, the latter triggers the relay valve 23 and through it the inlet valve 22. In this manner the pressure in the pressure chambers of stamps 4 and 5 is raised until the pressure in pushing ram 6 has again reached its desired value of, for example, 200 bar.

However, if the pressure in the pushing ram 6 rises during the advance of the shield-type support trestle 1, for example by driving into a wedge, the pressure in the stamp pressure chambers of stamps 4 and 5 is reduced until the desired pressure of, for example, 200 bar in the pushing ram 6 has been reached again.

Through the separate discharge valve 26, the return can be released to the open air if there should be a back pressure in the return line 18.

Upon completion of the advance, the trestle 1 is positioned as desired by altering the pump pressure to stamps 4 and 5 via activation of control valve 12.

We claim:

1. A method of moving a shield-type support trestle, the trestle having stamps arranged between a roof pressure cap and a lying skid, and control valves, the method comprising the steps of:

(a) reducing a pressure in pressure chambers of the stamps to attain a desired remainder pressure by activating an electronic control device via a pressure in a pressure line of the pushing ram, actuating a discharge valve via the electronic control device and opening an unlockable reflux valve via the discharge valve, the unlockable reflux valve being located between interconnected stamp pressure chambers of the stamps and a return line;

(b) pressurizing the pushing ram within a given time span from before attaining the remainder pressure until after;

(c) advancing the trestle via the pressurized pushing ram after the remainder pressure is attained;

(d) maintaining the remainder pressure in the stamps at an approximately constant value during said advancing of the trestle; and (e) positioning the shield-type support trestle after said advancing is completed by altering the pressure in the stamp chambers.

2. The method according to claim 1, wherein the predetermined pressure of the stamp pressure chambers is given to the electronic control device from a pressure value slightly above the desired remainder pressure, and said step of opening the unlockable reflux valve terminates once the desired remainder pressure is attained.

3. The method according to claim 1, wherein, in case of back pressure in the return line, medium flowing out of the stamp pressure chambers is released to the outer air.

4. The method according to claim 1, further including activating an inlet valve in communication with the stamp chambers by the electronic control device to increase the pressure in the stamp pressure chambers when the stamp pressure is below the desired remainder pressure.

5. The method according to claim 1, wherein said reducing step includes depressurizing the stamp chambers to a pressure of about 30 bar and then reducing this pressure to a remainder pressure of about 10 bar, and wherein said maintaining step includes maintaining this remainder pressure at approximately 10 bar.

6. A method of moving a shield-type support trestle having stamps arranged between a roof pressure cap and a lying skid, a pushing ram in the lying skid and control valves, the method comprising the steps of:

(a) applying pressure to the pushing ram;

(b) activating an electronic control device through a manometric switch when a certain pushing ram pressure is reached;

(c) actuating an unlockable reflux valve located in a line between the stamps and a return line via the activated electronic control device through a time function for a certain time span;

(d) lowering the stamp pressure through the electronic control device until the shield-type support trestle advances via a certain given moving pressure in the pushing ram;

(e) maintaining the moving pressure constantly during this advance; and (f) positioning the shield-type support trestle after the completed advance by altering pressure in the stamp chambers.

7. The method according to claim 6, wherein said actuating step includes triggering a discharge valve by the electrical control device.

8. The method according to claim 6, wherein said actuating step includes activating the electronic control device when a certain pressure of about 50 bar is reached.

9. The method according to claim 6, wherein said moving pressure is about 200 bar.

10. The method according to claim 6, wherein a pushing pressure of about 200 bar is constantly maintained during the advance of the trestle.

11. The method according to claim 6, wherein in case of back pressure, the medium flowing from the stamp chambers is led into the open air.

12. A device for moving a shield-type support trestle, the trestle comprising stamps having an inlet valve and a discharge valve and being arranged between a roof pressure cap and a lying skid, a pushing ram in the lying skid with a first control valve communicating with a piston chamber of the pushing ram and a second control valve communicating with an annular chamber of the pushing ram, and a return line, the moving device comprising:

a pressure line provided between the first control valve and the pushing ram of the trestle;

a valve controlled by pressure existing in said pressure line and which interconnects stamp pressure chambers of the stamps;

a manometric switch arranged on said pressure line, said switch activating an electronic control device;

an unlockable reflux valve provided in a line between the stamp pressure chambers and the return line; wherein said unlockable reflux valve is actuated through the electronic control device and the stamp discharge valve.

13. The device according to claim 12, wherein a pressure transducer is provided between the stamp pressure chambers of the stamps of the shield-type support trestle and the electronic control device, and wherein the electronic control device is activated upon said transducer sensing a certain set pressure.

14. The device according to claim 13, wherein certain set pressure is about 30 bar.

15. The device according to claim 14, wherein the certain pressure is lowered to about 10 bar.

16. The device according to claim 12 further comprising another discharge valve which is actuated by pressure existing in the return line.

17. Device for moving a shield-type support trestle, the trestle comprising stamps arranged between a roof pressure cap and a lying skid, a pushing ram in the lying skid with a first control valve in communication with a piston chamber of the pushing ram and a second control valve in communication with an annular chamber of the pushing ram, and a return line, the moving device comprising:

an electronic control device connected via a manometric switch and a pressure transducer to a pressure line located between the first control valve and the pushing ram;

a discharge valve and an inlet valve in communication with the stamps, said inlet and discharge valves activated via said electronic control device;

an unlockable reflux valve actuated by the discharge valve and the inlet valve and located in a line between the stamps and the return line; and a valve interconnecting pressure chambers of the stamps, said valve actuated via the pressure line located between the first control valve and the pressure ram.

18. The device according to claim 17, further comprising another discharge valve actuated by the return line.

19. The device according to claim 17, wherein the discharge valve is activated for a time period of about 1 to 2 seconds via the electronic control device.

20. A method of moving a shield-type support trestle, the trestle having stamps arranged between a roof pressure cap and a lying skid, a pushing ram in the lying skid, and control valves, the method comprising the steps of:

(a) reducing a pressure in pressure chambers of the stamps to attain a desired remainder pressure by activating an electronic control device via a pressure in pressure line of the pushing ram and opening a discharge valve via the activated electronic control device;

(b) pressurizing the pushing ram within a given time span from before attaining the remainder pressure until after;

(c) advancing the trestle via the pressurized pushing ram after the remainder pressure is attained;

(d) maintaining the remainder pressure in the stamps at an approximately constant value during said advancing of the trestle by opening the discharge valve via the activated electronic control to reduce pressure in the stamp chambers and opening an inlet valve via the activated electronic device to increase pressure in the stamp chamber as necessary; and (e) positioning the shield-type support trestle after said advancing is completed by altering the pressure in the stamp chambers.

21. The method according to claim 20, wherein the electronic control device is activated by the pressure in the pressure line which is in communication with interconnected stamp pressure chambers.

* * * * *